US005580215A

United States Patent [19]

Sidelko et al.

[11] Patent Number: 5,580,215

[45] Date of Patent: Dec. 3, 1996

[54] CENTRIFUGAL PUMP WITH ELECTROMAGNETIC ACTUATOR MECHANISM

[75] Inventors: John E. Sidelko, Littleton; Douglas W. Drussel, Sedalia; Gary W. Deffner, Englewood, all of Colo.

[73] Assignee: A. R. Wilfley & Sons, Inc., Denver, Colo.

[21] Appl. No.: 369,702

[22] Filed: Jan. 6, 1995

[51] Int. Cl.[6] ..... F04D 29/14

[52] U.S. Cl. ..... 415/113; 415/230

[58] Field of Search ..... 415/13, 113, 230, 415/231

[56] References Cited

U.S. PATENT DOCUMENTS

| | | | |
|---|---|---|---|
| 3,708,177 | 1/1973 | Baermann | 277/80 |
| 4,304,411 | 12/1981 | Wilcock et al. | 277/80 |
| 4,335,885 | 6/1982 | Neshmet | 277/13 |
| 4,439,096 | 3/1984 | Rockwood et al. | 415/230 |
| 4,455,026 | 6/1984 | Pinkus et al. | 277/1 |
| 4,527,802 | 7/1985 | Wilcock et al. | 277/1 |
| 4,915,579 | 4/1990 | Whittier et al. | 415/171.1 |
| 5,228,844 | 7/1993 | Klopfer et al. | 417/440 |
| 5,261,786 | 11/1993 | Sidelko | 41.5/171.1 |
| 5,411,366 | 5/1995 | Rockwood | 415/231 |

*Primary Examiner*—Edward K. Look
*Assistant Examiner*—Mark Sgantzos

[57] ABSTRACT

An electromagnetic seal for a centrifugal pump controls movement of a valve member away from a normally closed position against a sealing surface at the entrance to a reservoir behind the expeller region of the pump, the valve member being controlled by a magnetizable clapper movable within a sealed enclosure toward and away from an electromagnetic coil which may be energized either by the drive motor of the pump or a self-contained generator in the pump driver assembly. Circulation of fluids between the impeller and expeller regions of the pump is enhanced by placement of vents in the impeller and a circumferential groove in the path of flow of fluid through the expeller to create increased turbulence and assist in flushing out foreign particles along with fluid in the expeller region when the pump is in operation. The effectiveness of this combination permits the employment of dry running secondary containment seals which do not require elaborate seal support systems.

23 Claims, 5 Drawing Sheets

CENTRIFUGAL PUMP WITH ELECTROMAGNETIC ACTUATOR MECHANISM

BACKGROUND AND FIELD OF INVENTION

This invention relates to centrifugal pumps, and more particularly relates to a novel and improved centrifugal pump of the hydraulic sealing type and to a novel and improved electromagnetic actuator mechanism therefor which will effectively seal against leakage behind the expeller region of the pump without any frictional engagement of a seal or gland on any rotating element of the pump.

BACKGROUND AND FIELD OF THE INVENTION

A. R. Wilfley & Sons, Inc., the assignee of this invention, has made substantial advancements in the development of centrifugal pumps of the type described. Of the more recent advancements, U.S. Pat. No. 4,915,579 to Whittier et al is characterized in particular by completely isolating the actuating mechanism of the valve assembly from the liquid in the reservoir and in which the actuating mechanism comprises centrifugal force-responsive pivot members which will overcome the normal biasing of the spring-loaded valve assembly to open the valve assembly and make possible the discharge of liquid from the reservoir region of the pump during start-up periods, and the actuating mechanism is sealed at all times from the working fluid so as not to be exposed to contaminants or foreign particles in the fluid. Further, in Whittier et al, there is disclosed a novel and improved expeller ring and baffle plate arrangement in the path of fluid flow between the expeller ring and seal housing to discourage the flow of fluid from the pump casing into the seal housing. In U.S. Pat. No. 5,261,786 to Sidelko, washer-like spring elements are provided as a part of the spring-loaded valve assembly in which the regressive characteristics of the spring elements are such that they will undergo a large degree of deflection for a relatively small change in force at a speed just below the operating speed of the pump so that the valve will not begin to move away from the closed position until the pump is substantially up to operating speed; and as the pump speed is reduced below its operating speed, the spring elements will rapidly expand so as to cause almost instantaneous closure below the operating speed of the pump to avoid leakage of fluid back into the reservoir housing. As in the '579 to Whittier et al, the '786 patent to Sidelko utilizes centrifugal force-responsive, weighted pivot members isolated within a seal housing to overcome the bias or urging of the spring-loaded valve assembly. In certain pump applications, such as, those handling low surface tension fluids, there is a need for a valve assembly which can achieve positive opening and closing of the reservoir behind the expeller region during start-up and shut-down periods with a closely controlled force so as to enable use of highly sensitive seals and ease the hydraulic load on the bearings behind the expeller region; and further to insure complete removal of any fluid in the region adjacent to the valve assembly seals during the start-up period. It is therefore proposed in accordance with the present invention to provide a novel and improved actuating mechanism for the valve assembly which can be closely controlled independently of centrifugal force to regulate opening and closing of the valve assembly and which actuating mechanism is compact and can be completely isolated from the working fluids and any contaminants in the fluid. Furthermore, it is proposed to improve the circulation of the working fluid and entrained contaminants or foreign particles through the expeller region during operation of the pump.

SUMMARY OF THE INVENTION

It is therefore an object of the present invention to provide for a novel and improved pump sealing apparatus which is capable of opening and closing a valve assembly under a closely controlled degree of force and time frame during start-up and shut-down periods and independently of the operating speed of the pump.

Another object of the present invention is to provides for a novel and improved valve actuating mechanism for centrifugal pumps which is compact, employs a minimum number of working elements and provide both primary and secondary containment against leakage through all moving joints in the pump.

A further object of the present invention is to provide for a novel and improved pump sealing apparatus which is specifically adaptable for use with working liquids having low surface tension, is capable of easing the hydraulic load on the bearings in the shaft mounting region of the pump and achieves improved circulation of fluid via the expeller region of the pump.

An additional object of the present invention is to provide for a novel and improved pump sealing apparatus in which an actuating mechanism is completely isolated from the liquid in the reservoir and which mechanism is of the electromagnetic type which can be closely controlled independently of the operating speed of the pump to effect positive opening and closing of the valve assembly for the reservoir region of the pump.

Another object is to provide highly sensitive gas sealing devices which require no additional seal support system and are lubricated by the surrounding atmosphere.

A still further object of the present invention is to provide for alternate forms of electromagnetic actuating mechanisms for centrifugal pumps of the type described and which actuating mechanisms are controllable either by an external power supply or internal generator.

DETAILED DESCRIPTION OF THE PREFERRED EMBODIMENT

Figure 1:
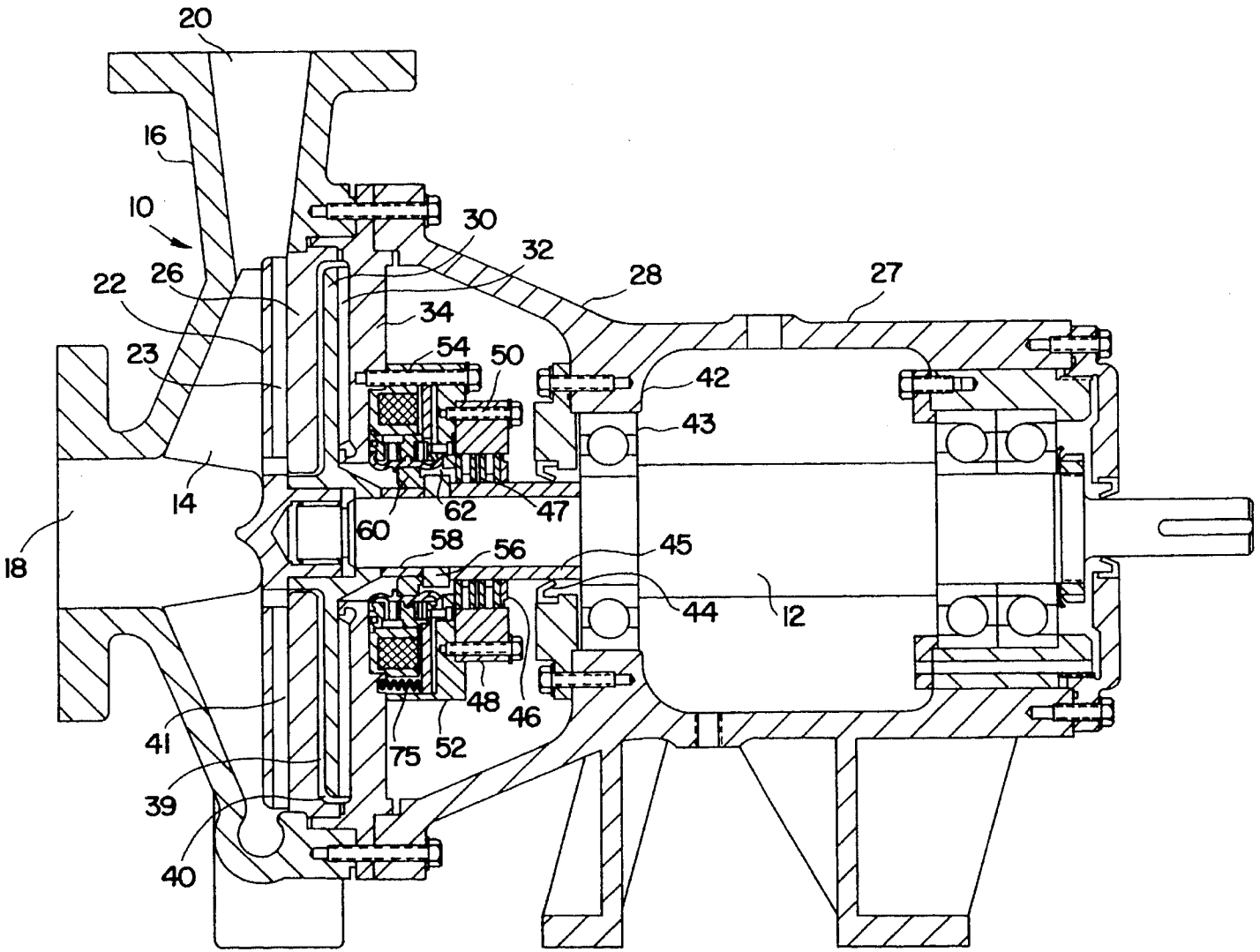
FIG. 1 is a longitudinal sectional view of the preferred form of invention illustrating the valve assembly in the closed position.
Figure 2:
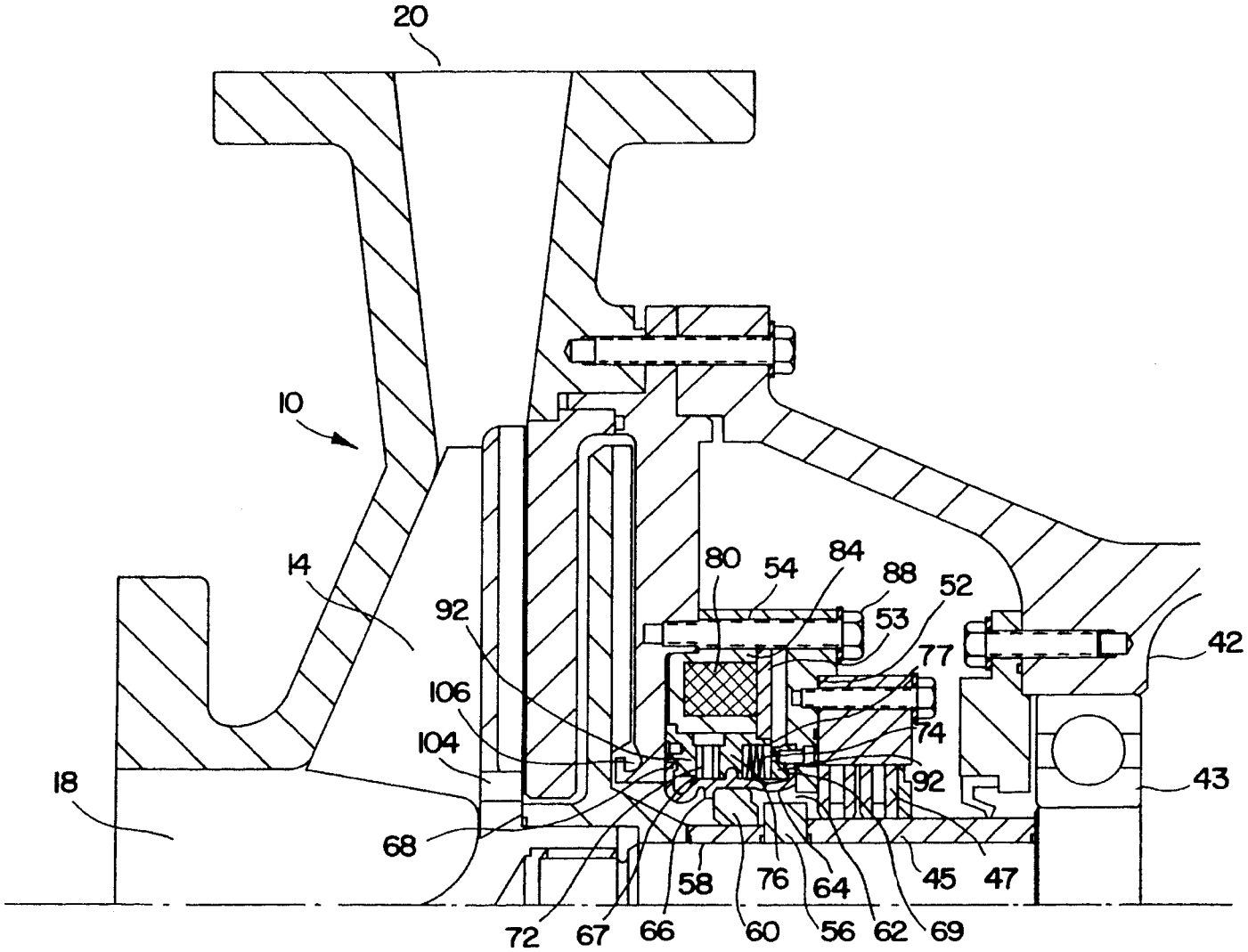
FIG. 2 is a longitudinal half-sectional view of the preferred invention illustrating the valve assembly in the open position.

Referring in more detail to the drawings, FIGS. 1 and 2 illustrate a preferred form of pumping apparatus 10, FIG. 1 depicting the valve member in a closed position when the pump is not in operation and FIG. 2 depicting the valve member in the open position when the pump is in operation. The preferred form of pumping apparatus 10 includes a drive shaft 12 and an impeller 14 mounted for rotation on the drive shaft 12 within an outer pump housing 16. The housing 16 includes an inlet 18 at its forward end for introduction of a working liquid and, under rotation of the impeller 14, the liquid is driven in an outward radial direction through the discharge or outlet 20. A primary expeller 22 includes radially extending, circumferentially-spaced vanes 23 on its rearward surface, and a case plate 26 is interposed between the expeller vanes 23 and a secondary expeller 30 having rearwardly directed, radially extending vanes 32. The expeller 30 is interposed between the case plate 26 and an expeller plate 34 which is attached at its outer periphery to the housing 16 to establish circumferentially extending gaps 39 and 40 communicating with one another around the outer peripheral end of the expeller 30, and the gaps 39 and 40 form a part of a continuous fluid channel communicating with interface 41 between the plate 26 and expeller vanes 23.

An extension 28 of pump bearing frame 27 includes an end wall 42 journaled to the shaft 12 by bearing assembly 43, an oil seal 44 engages a sleeve 45 mounted on the shaft 12, and a secondary containment seal(s) 46 is disposed behind the reservoir region. In low pressure applications, preferably the seal 46 is a ferrofluid seal which functions as a gas seal, such as, Model EMS 1937sold by Ferrofluidic Corp. of Nashua, N.H. As shown, the ferrofluid seal is comprised of a ring of stationary permanent magnets and pole pieces 47 located around the sleeve 45 and a ferrofluid which consists of small magnetic particles, not shown, that are coated with a special surfactant and immersed in a viscuous fluid. The fluid is held in contact both with the sleeve 45 and pole pieces 47 by the magnetic flux fields of the ring 47. It is therefore important to avoid direct contact between the seal and fluid in the housing. The seal 46 is mounted on a rearward extension 48 which is fastened by suitable fasteners in the form of studs 50 to a rearward end wall 52 of an electromagnetic cover or housing 54. A rotating seal member 56 is mounted on the shaft 12 between the sleeve 45 and a forward sleeve member 58, the seal 56 cooperating with a stationary seal 60 inside of the cover 54 to define a valve assembly between a chamber or reservoir 62 and the expeller region. In this relation, the ferrofluid seal 46 operates as a gas tight barrier which in low pressure applications is capable of sealing one end of the reservoir 62 from the atmosphere without the use of additional expensive and elaborate seal support systems. In that the vacuum or lower pressure level exists in the expeller area any leakage is always in the direction of the pressure drop from atmospheric pressure outside of the pump into the expeller region and not in the reverse direction.

Preliminary to a detailed description of the electromagnetic actuating mechanism, broadly the stationary seal 60 is affixed to an annular elastomeric joint or diaphragm member 64 defining an inner wall surface of the cover 54 to prevent leakage of fluid into the housing 54 from the reservoir region. The diaphragm 64 is in the form of an annular boot composed of an elastomeric material including an internal circumferential rib 66 bearing against the seal 60, an external rib 67 which is press fit into a groove in a ring 76, and flanges 68 and 69 at opposite ends of the diaphragm are held stationary or anchored against the expeller plate 34 and the end wall 52, respectively. The seal 60 is a facial seal having a surface which engages the front face of the seal 56, and the seal 60 follows the axial movement of the diaphragm 64. Primary and secondary bellows 72 and 74 are preferably hydroformed to define generally accordion-shaped secondary seals. In the alternative, the bellows 72, 74 can be welded metal, hydroformed metal, welded plastic or molded plastic. The bellows 72, 74 are disposed in axially spaced relation to one another in outer surrounding relation to the diaphragm 64 and are separated by the ring 76 having a rearward axial extension 77 affixed to the radially inner end of a clapper 53.

In the preferred form, the electromagnetic actuating mechanism is defined by the clapper 53 which is in the form of an annular magnetizable plate extending radially and outwardly from the extension 77 within the cover 54. The ring 76 is provided with a groove on its inner radial surface which receives the rib 67 of the diaphragm 64 so as to follow the axial displacement of the clapper 53. The clapper 53 is slidable in an axial direction between an annular coil 80 mounted in an annular, channel-shaped housing 84 and the end wall 52. An exposed end of the coil is in confronting relation to the clapper 53 and, when energized, will cause the clapper 53 to be attracted to the coil 80 and displaced axially to overcome the urging of a series of circumferentially spaced springs 75 extending between the clapper 53 and the expeller plate 34. The clapper 53 will force the diaphragm 64 to be displaced in a forward direction causing the seal 60 to move away from the seal face 56 and to open the reservoir 62 only after all the liquid has been evacuated by the expeller.

The housing 84 is anchored to the fixed expeller plate 34 by suitable fasteners 88. Stationary front and rear support blocks 92 and 92'are anchored to the housing 84 and end wall 52, respectively, of the cover 54 to securely retain the flanges 68 and 69 of the diaphragm 64 in fixed relation to the expeller plate 34 and end wall 52, as shown, as well as to serve as end stops for the primary and secondary bellows 72 and 74, respectively.

It is highly desirable to encourage circulation of the working fluid and any entrained foreign particles through the expeller region and, particularly during the start-up period, to enable removal of the fluids from the region surrounding the seal 60 so that when the valve assembly is open fluid will not tend to migrate into the reservoir area behind the seals 56 and 60. To this end, a series of vents 104 extend through inner radial ends of the vanes on the impeller 14 to enable circulation of liquid from the inlet into the expeller region and eliminate formation of thermal "hot spots" during operation of the pump. Circulation is improved also by the construction of the expeller plate 34 which includes a generally channel-shaped open circumferential groove or pocket 106 at its inner radial end with an entrance facing somewhat forwardly in an outward radial direction toward the inner circumferential edges of the expeller vanes 32. Thus, fluid flowing rearwardly from the expeller region will undergo somewhat of a reversal in flow in passing into the channel 106 and create increased turbulence which will minimize any tendency for foreign particles or fluid to collect in the region surrounding the seal 60. As a result, the pumping apparatus as described is particularly adaptable for use in working fluids which contain foreign particulates that may tend to be corrosive and abrasive by flushing out those particles along with any fluid. For this reason, the pumping apparatus and particularly the seals 56 and 60 are capable of running dry and avoid the necessity of flushing out the pump and seals to remove foreign particles.

Figure 3:
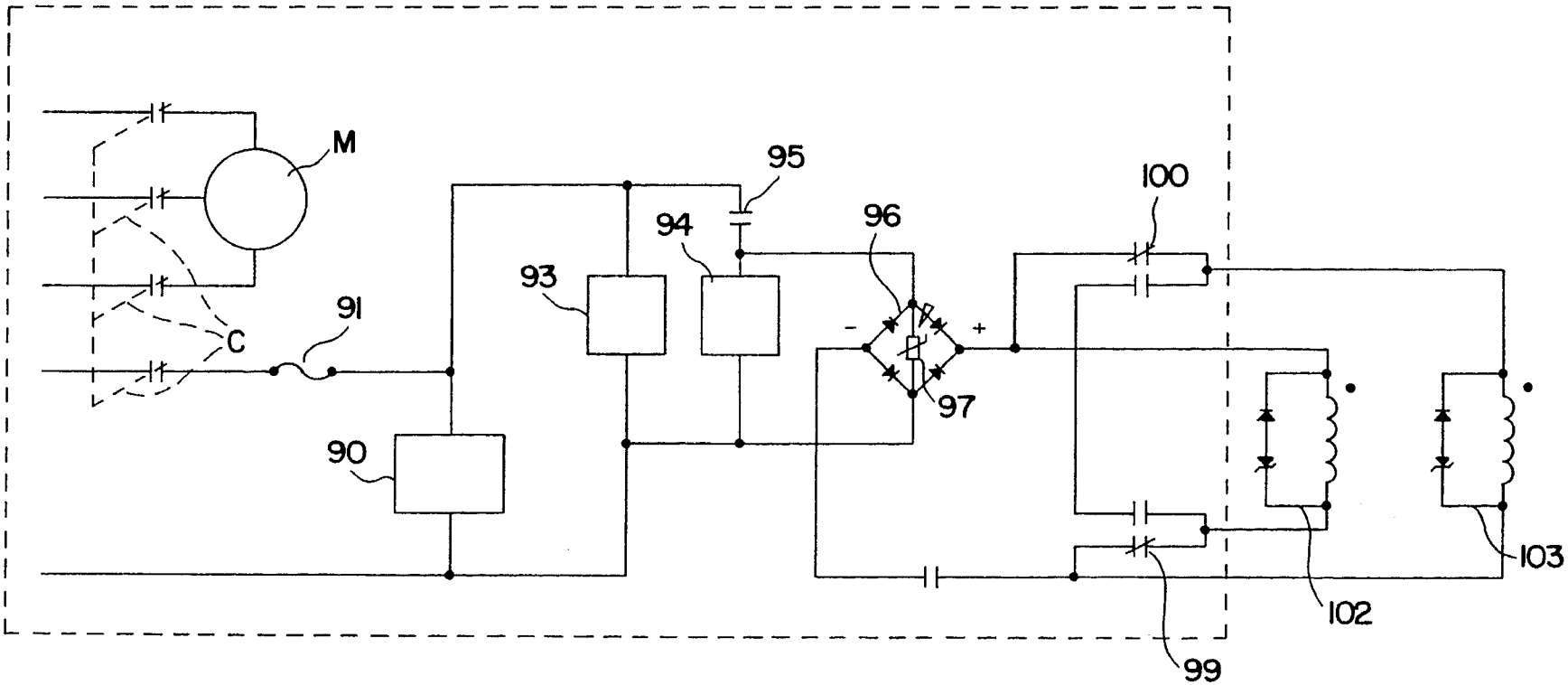
FIG. 3 is a block diagram of the energizing circuit for the electromagnetic valve control of the preferred form of invention.

In the preferred form, the energizing means for the electromagnetic actuation mechanism takes the form of an energizing control circuit, as shown in FIG. 3, which includes a standard three phase motor represented at M which operates the pump 10. A set of auxiliary contacts C are connected across a pair of delay timers 93 and 94 and a capacitor 95. A full wave bridge 96 converts AC power to DC power and is connected across the output of the delay timers 93 and 94 including a metal oxide varistor 97, and the positive side of the bridge is connected through relays 99 and 100 for the delay timers 93 and 94 to the primary windings 102 and secondary windings 103 which make up the coil 80. A fuse 91 protects the windings 102 and 103. Preferably the coil 80 is manufactured and sold by Inertia Dynamics of Collinsville, Conn. and with a magnetic force capable of overcoming a 25 lb. spring loading. For the purpose of illustration, a gap of 0.140"is established between the clapper member 53 and the channel 84. The delay timer 93 is set to establish a three to fifteen second time delay to actuate the electromagnetic coil 80 after the motive drive source for the pump is started. After the preselected time delay, delay timer 93 times out, the delay timer contacts are closed, and delay timer 94, bridge 96 and windings 102 and 103 are energized. The circuitry is such that the current flows through the two separate windings in parallel which doubles the strength of the coil 80 in order that the coil can draw the clapper 53 across a much greater air gap on the order of 0.140"and allow greater tolerance allowance on the rest of the machined parts, greater field adjustability of the pump and more seal wear resulting in longer life. After the clapper 53 is drawn tightly against the coil housing 84, very little electromagnetic force is needed to keep the seal open. The delay timer 94 times out after 0.5 seconds, closing the timer contacts, then switch the separate windings 102 and 103 to series operation. This reduces the current level and temperature rise in the windings 102 and 103 during operation. When the motor M is shut off, control relay 90 is deenergized so that its contact is opened and the electromagnetic windings 102 and 103 are deenergized instantly to allow the seal to close. When the windings 102 and 103 are deactivated, the return springs 75 will return the facial seal 60 to its closed position. The secondary bellows 74 operates in such a manner as to create some resistance to the closing force of the primary bellows 72 and springs 75 thereby reducing the rate of closing movement of the seals and minimizing wear on the seals. The counter-balancing bellows arrangement as herein described in which the bellows 72, 74 and springs 75 are mounted under compression effectively damps the movement of the clapper 53, particularly in a closing direction, so as to minimize any tendency of the clapper 53 to "chatter" as facial seal 60 moves into contact with rotating seal member 56. Preferably, the spring rates of the bellows 72, 74 and springs 75 are such that any slight movement off-center is quickly damped.

For the purpose of illustration but not limitation, the schematic symbols employed in FIG. 3 are per ANSI IEEE 315-1975 unless otherwise specified. Thus, for example, the relay 90 may be a P&B No. KUP-5A55-120, the timers 93 and 94 may be 55 AC No. ERDM423 and 422, respectively, and the bridge 96 may be a FAGOR No. FBU4K with the metal oxide varistor being a Harris No. V150LA20A. The pumping apparatus 10 complies with ANSI standard B 73.1 in terms of head, flow range, size and shape. In operation, when the coil windings 102 and 103 are energized a predetermined time interval after start-up, the clapper 53 is drawn against the end of the housing 84 to force the seal 60 away from engagement with the seal 56 and secondary expeller 30 to prevent fluid from passing into the chamber 62 from the expeller region. After the delay timer 94 times out, the windings 102 and 103 switch to series operation to reduce the strength of the windings during operation. When the main motor M is shut off, as described earlier, the windings 102 and 103 are deenergized instantly allowing the primary bellows 72 to overcome the secondary bellows 74 with further assistance from the springs 75 and urge the seal 60 into a closed position with respect to the seal 57 to isolate the chamber 62 from the pumped fluid. It will be evident that other means may be employed for adjustment of the current flow so that initially a higher current is provided to create a stronger magnetic field during clapper movement and a lower current to decrease power consumption and temperature rise in the coils when the pump is in operation.

DETAILED DESCRIPTION OF MODIFIED FORM OF INVENTION

Figure 4:
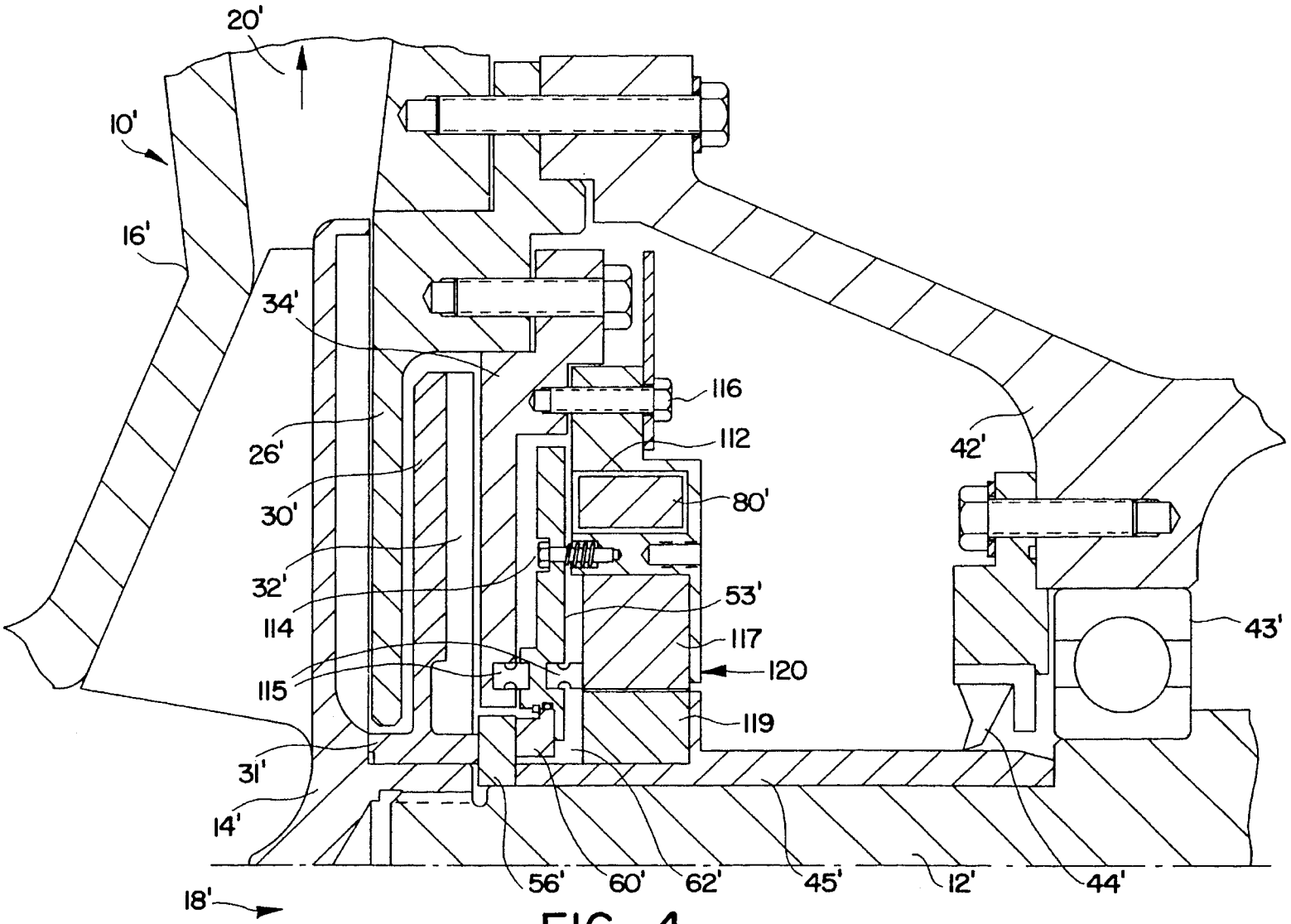
FIG. 4 is a longitudinal half-sectional view of a modified form of invention.
Figure 5:
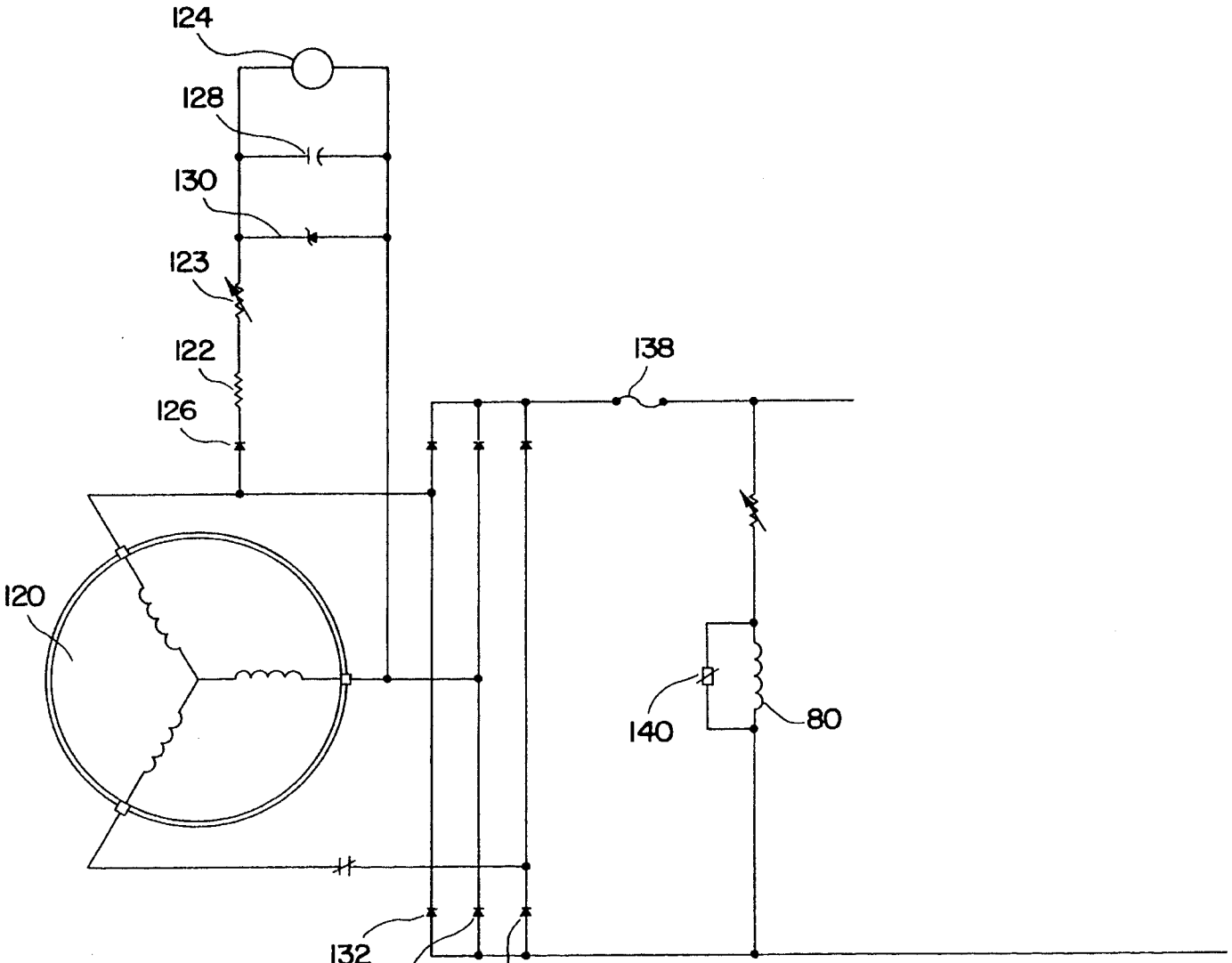
FIG. 5 is a block diagram of an energizing circuit for the modified form of invention.

A modified form of invention is shown in FIGS. 4 and 5 wherein like parts to those of the preferred form are correspondingly enumerated with prime numerals. In the modified form, pumping apparatus 10' includes a drive shaft 12', impeller 14', pump case 16'with inlet 18' and discharge or outlet 20'. An expeller 30' having radially extending vanes 32' is interposed between a case plate 26' and expeller plate 34'. The expeller 30' also includes a hub 31' rotatable with shaft 12' via the impeller 14', and an annular seal 56' is disposed at the rearward end of the hub 31' in confronting relation to a non-rotatable seal 60'. The seal 56' is rotatable with the hub 31' and shaft 12'; and in the relationship shown in FIG. 4, the seal 60' is disposed in flush engagement with the seal 56'. The seal 60' also is of annular configuration and fixed to an inner radial end of an annular clapper 53', the latter being disposed in normally axially spaced relation to a mounting ring 112 by a series of spring-loaded fasteners 114. The fasteners 114 are mounted under compression to urge the seal 60' at the inner radial end of the clapper 53' into a normally closed position against the seal 56'. The clapper 53' is further supported by a pair of compliant suspension members in the form of X-rings 115 which project away from the inner radial end of the clapper into engagement with the expeller plate 34' and mounting ring 112. The mounting ring 112 is affixed to the expeller plate 34' by suitable fasteners 116 and carries a three-phase AC generator 120 including stator coil 117 and an electromagnet including actuator coils 80' in inner and outer concentric recessed portions of the mounting ring 112, respectively. An end wall 42' of the bearing frame terminates in a bearing 43', and an oil seal 44' engages the outer surface of a rotor sleeve 45' mounted on the shaft 12'.

A series of permanent magnets 119 form a part of the generator and are disposed in spaced circumferential relation to one another and in outer surrounding relation to and fixed within the sleeve 45' with the stator coil 117 disposed in outer surrounding relation to the magnets 119. The space between mounting ring 112 and oil seal 44' is suitable for installation of any of a variety of dry running, gas lubricated, secondary containment sealing devices.

As illustrated in FIG. 5, when the pump is started by its own drive mechanism, the generator 120 must develop sufficient power to overcome resistor 122, and a second adjustable resistor 123 is provided to determine magnet strength versus current. A zener diode 126 controls the minimum and maximum power in the system, and a capacitor 128 and voltage control diode 130 are connected in parallel across the relay 124, the diode 130 controlling the voltage across the relay and the capacitor 128 acting to smooth any power spikes. A bank of diodes consisting of three pairs of diodes 132, 134 and 136 are connected across the output of the generator 120 so that when the relay 124 is energized, the diode pairs 132, 134 and 136 will act as a full wave bridge to convert the AC power from the generator to DC power and deliver to the electromagnet 80'. A fuse 138 is provided at the output from the bridge circuit and an arc suppressor 140 across the electromagnet 80' prevents the introduction of any surges or power spikes to the electromagnet 80'.

In practice, the resistance 122 is selected such that the relay 124 is not closed until the expeller 30' is up to full speed. Once the relay 124 is closed to develop the generator output to the electromagnetic 80', sufficient magnetic energy is developed to overcome the spring-loaded fasteners 114 and the suspension members 115 to move the seal 60' away from engagement with the seal 56' and open the reservoir. When the main driver for the pump is shut off, the pump shaft will decelerate until the current generated by the generator is insufficient to overcome the resistance 122, and the relay 124 will then open whereby the clapper 53' will return to its forward position away from the mounting ring 112 under the urging of the fasteners 114 until seal 60' engages seal 56'.

Among other features of the modified form of invention is its ability to minimize outside electrical connections and is therefore more readily adaptable for use in remote installations, for diesel or turbine-driven machine applications, and for retrofit of existing installations. Although the generator 120 is illustrated as being mounted near the pumped fluid, it can be mounted wherever there is access to a rotating shaft, such as, in the pump bearing frame, near the pump/driver coupling, or on the fan end of the motor.

It is therefore to be understood that while preferred and modified forms of invention are herein set forth, various modifications and changes may be made without departing from the spirit and scope of the invention as defined by the appended claims and reasonable equivalents thereof.

I claim:

1. A centrifugal pumping apparatus having an outer housing, impeller, expeller, reservoir and rotary drive shaft provided with an annular seal rotatable with said shaft and a bearing interposed between said housing and shaft, the combination therewith comprising:

an annular valve member moveable between open and closed positions in relation to a face of said seal whereby to prevent passage of working fluid between said expeller and reservoir;

biasing means engageable with said valve member to retain said valve member in a closed position against said seal when said apparatus is not in operation; and actuating means for overcoming said biasing means to move said valve member to an open position including an actuating member, an electromagnetic drive member in the path of movement of said actuating member, and energizing means electrically connected to said electromagnetic drive member to selectively energize said drive member whereby to initiate movement of said actuating member in a direction overcoming said biasing means to open said valve member.

2. Apparatus according to claim 1, said energizing means including delay means for energizing said energizing means a predetermined time interval after start-up of said pumping apparatus.

3. Apparatus according to claim 2, said biasing means including at least one return spring member normally urging said valve in a direction closing said seal.

4. Apparatus according to claim 1, said actuating means including a sealed enclosure for said electromagnetic drive member in surrounding relation to said actuating means.

5. Apparatus according to claim 4, said actuating means being in the form of an annular, magnetizable plate in surrounding relation to said shaft and said sealed enclosure being in the form of an annular housing.

6. Apparatus according to claim 1, said enclosure including a resilient sleeve member in outer, spaced surrounding relation to said shaft.

7. Apparatus according to claim 6, said sleeve member having counter balancing bellows disposed in opposition to one another in outer surrounding relation to said shaft.

8. Apparatus according to claim 1, said drive member including first and second electromagnetic coils.

9. Apparatus according to claim 8, said energizing means including a full wave rectifier and time delay means associated with said rectifier.

10. Apparatus according to claim 7, said actuator member being in the form of an axially movable annular plate having a radially inner portion interposed between said bellows.

11. In apparatus wherein a centrifugal pump includes an outer housing with a reservoir in outer spaced surrounding relation to a drive shaft, a motive drive source for starting said pump, an impeller on said drive shaft to discharge liquid introduced from an inlet through an outlet; at least one expeller disposed between said impeller and said reservoir and a fluid channel establishing fluid communication between said expeller(s) and said reservoir when said pump is in operation, the improvement comprising:

a sealing surface portion on said drive shaft and a secondary containment seal in axially spaced relation to said sealing surface portion;

an annular valve member movable between open and closed positions in relation to said sealing surface portion and movable to a closed position against said sealing surface portion to prevent passage of fluid between said expeller(s) and said reservoir including means yieldingly urging said valve member into the closed position; and electromagnetic drive means engageable with said valve member to advance said valve member to the open position, said drive means including energizing means for selectively energizing said drive means a predetermined time interval after said motive drive source is started.

12. Apparatus according to claim 11 wherein said energizing means includes a generator.

13. Apparatus according to claim 12 wherein said generator includes an electrical drive circuit for energizing said electromagnetic drive means a predetermined time interval after said motive drive source is started.

14. Apparatus according to claim 13, wherein said drive circuit includes means for adjusting the current level applied to said drive member when said pump is in operation.

15. Apparatus according to claim 11, wherein said drive means includes an annular magnetizable plate in surrounding relation to said shaft between said expeller and said reservoir.

16. Apparatus according to claim 15, including a sealed enclosure in surrounding relation to said electromagnetic drive means.

17. Apparatus according to claim 16, wherein said sealed enclosure includes double resilient bellows members on axially opposed sides of said drive means.

18. Apparatus according to claim 11, wherein said secondary containment seal is a ferrofluid seal disposed in surrounding relation to said drive shaft.

19. Apparatus according to claim 16, said ferrofluid seal mounted for inward radial extension from said sealed enclosure in axially spaced relation to said valve member.

20. Apparatus according to claim 1 wherein said expeller includes primary and secondary expellers between said impeller and said reservoir to resist liquid flow past said expellers when said pump is in operation, vents disposed in said impeller, said secondary expeller disposed between said primary expeller and said reservoir, and said secondary expeller having radially extending vanes provided with means to impart reverse flow to liquid passing radially along said vanes.

21. Apparatus according to claim 20, said reverse flow means defined by arcuate pockets at inner radial ends of said vanes.

22. Apparatus according to claim 20, wherein said impeller is provided with impeller vanes, and said vents are disposed at inner radial end of said impeller vanes.

23. Apparatus according to claim 22, wherein said vents extend in axial direction.

* * * * *